US008628270B2

(12) United States Patent
Maritano

(10) Patent No.: US 8,628,270 B2
(45) Date of Patent: Jan. 14, 2014

(54) DAMPING FLOOR AND FLEXIBLE COMPOSITE STRUCTURE, FOR EXAMPLE FOR PLAYING FIELDS

(75) Inventor: Riccardo Maritano, Brescia (IT)

(73) Assignee: Agripool S.r.l. A Socio Unico, Brescia (IT)

( * ) Notice: Subject to any disclaimer, the term of this patent is extended or adjusted under 35 U.S.C. 154(b) by 0 days.

(21) Appl. No.: 13/497,750

(22) PCT Filed: Sep. 14, 2010

(86) PCT No.: PCT/IB2010/054123

§ 371 (c)(1), (2), (4) Date: Mar. 22, 2012

(87) PCT Pub. No.: WO2011/036600

PCT Pub. Date: Mar. 31, 2011

(65) Prior Publication Data

US 2012/0177851 A1 Jul. 12, 2012

(30) Foreign Application Priority Data

Sep. 23, 2009 (IT) ..... 2009A0175

(51) Int. Cl.
*E01C 3/06* (2006.01)
*E01C 9/00* (2006.01)

(52) U.S. Cl.
USPC ..... 404/17; 404/31; 428/17

(58) Field of Classification Search
USPC ..... 404/17, 31, 34–43; 442/370; 428/17
See application file for complete search history.

(56) References Cited

U.S. PATENT DOCUMENTS

| | | | | |
|---|---|---|---|---|
| 3,661,687 | A * | 5/1972 | Spinney et al. | 428/17 |
| 3,978,258 | A * | 8/1976 | Faust et al. | 428/159 |
| 6,372,310 | B2 * | 4/2002 | de Vries | 428/17 |
| 6,723,413 | B2 * | 4/2004 | Walters | 428/95 |
| 2003/0118405 | A1 | 6/2003 | Sakamoto | |
| 2005/0260913 | A1 * | 11/2005 | Doesburg | 442/370 |
| 2006/0120803 | A1 | 6/2006 | Blackwood | |
| 2006/0141231 | A1 * | 6/2006 | Lemieux | 428/218 |
| 2008/0176010 | A1 * | 7/2008 | Sawyer et al. | 428/27 |
| 2009/0188172 | A1 * | 7/2009 | DuCharme et al. | 52/11 |

FOREIGN PATENT DOCUMENTS

DE 102004032219 A1 1/2006

OTHER PUBLICATIONS

International Search Report and Written Opinion (mailed May 4, 2012, for WO2011/036600 claiming benefit of ITBS2009A/000175; PCT/IB2010/054123, Filed Sep. 14, 2010).

* cited by examiner

*Primary Examiner* — Raymond W Addie
(74) *Attorney, Agent, or Firm* — Harness, Dickey & Pierce, PLC

(57) ABSTRACT

A floor (1) in synthetic grass comprises a substrate (2) in clay, a covering (8) in synthetic grass and an intermediate flexible support structure (12), positioned between the substrate and the covering. The support structure extends in an undulated manner, forming overhanging portions (18) which give the desired yield. Through slots are provided in the support structure for drainage.

18 Claims, 4 Drawing Sheets

DAMPING FLOOR AND FLEXIBLE COMPOSITE STRUCTURE, FOR EXAMPLE FOR PLAYING FIELDS

CROSS REFERENCE TO RELATED APPLICATIONS

This application is a 371 U.S. National Stage of International Application No. PCT/IB2010/054123, filed Sep. 14, 2010, which claims priority to Italian Patent Application No. BS2009A000175, filed Sep. 23, 2009. The disclosures of the above applications are incorporated herein by reference.

FIELD

The present invention relates to a damping floor, for example for playing fields in synthetic grass, and a flexible composite structure for said floor.

BACKGROUND

It is known of to make playing fields in synthetic grass by first constituting a substrate in clay (or even in cement), on which the covering of synthetic grass, usually in rolls, is placed. Sometimes a waterproof film is positioned between the substrate and the covering of synthetic grass for drainage of rainwater.

Despite synthetic grass being soft, the playing field transmits a hard sensation to the user however, especially when running, falling or chasing after a bouncing ball.

In fact, the synthetic grass covering is fully compressed under the user's weight, inasmuch as extremely yielding; so that the user immediately feels the presence of the compact substrate in clay.

Some solutions envisage the use of an under layer in soft synthetic material, for example rubbery material, positioned between the substrate and synthetic grass covering.

Such solution, however, poses serious problems for proper drainage of the playing field, in that the water tends to accumulate between the covering and rubbery under layer, creating puddles which take an extremely long time to dry.

SUMMARY

The purpose of the present invention is to make a damping floor and a flexible composite structure, for example for a field in synthetic grass, such as a playing field.

Such purpose is achieved by a floor and by a structure made according to the disclosed embodiments.

DRAWINGS

The characteristics and advantages of the present invention will be evident from the following description made by way of a non-limiting example, with reference to the attached drawings, wherein.

DETAILED DESCRIPTION

Figure 1:
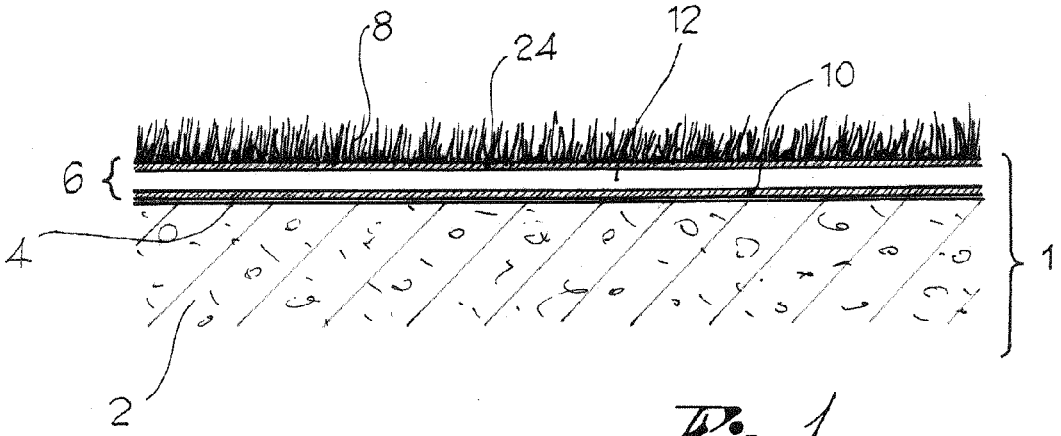
FIG. 1 shows a plan of a floor according to the present invention, according to one embodiment.

With reference to the attached figures, reference numeral 1 globally denotes a floor according to the present invention, comprising:

- a substrate 2, for example made from clay or cement and the like;
- a waterproof layer 4, positioned over the substrate 2, made in waterproof material, for example made as a polythene film;
- a composite structure 6, positioned over the waterproof layer 4; and
- a covering 8, for example in synthetic grass or similar fabric, positioned over the composite structure 6.

The composite structure 6, comprises an under layer in textile material, for example made from polypropylene thread, for example multifilament, and a flexible support structure 12.

The under layer 10 in textile material has crests 15 and valleys 15' which extend in a deformation direction X, substantially in a rectilinear manner.

The support structure 12 rests on the under layer 10 and is attached to it, for example sewn or nailed to it.

The support structure 12 extends over the substrate 2 in a deformation direction X in an undulated manner.

In other words, along the deformation direction X, the support structure 12 has alternating crests and valleys, in sinuous succession.

In particular, the support structure 12 comprises main ribs 14 which extend in a transversal direction Y, orthogonal to the deformation direction X.

The ribs 14 are preferably vertically distanced from the substrate 2 and from the under layer 10.

The support structure 12 preferably further comprises a plurality of tabs 16, projecting from the rib 14, transversally distanced, that is along the transversal axis Y.

The tab 16 comprises an overhanging portion 18; projecting from the rib 14 towards the substrate 2 or under layer 10, which in the non-deformed configuration of the support structure 12, in other words when said structure is not being walked on, is vertically distanced from the substrate 2 or from the under layer 10.

The tab 16 further comprises a support portion 20, connected to the overhanging portion 18 resting on the substrate 2 or under layer 10.

Preferably, the tab 16 is arched, for example convex on the side facing the substrate 2 or under layer 10.

Preferably, the tab 16 decreases in thickness from the proximal extremity attached to the rib 14 to the free distal extremity.

According to a preferred embodiment, the tabs 16 of successive ribs 14 penetrate each other along the deformation direction X.

In other words, from a first rib 14' transversally spaced first tabs **16*a*' protrude, so as to form recesses between them; from a second rib 14", flanking the first rib in a deformation direction X, transversally spaced second tabs 16*a*" protrude; the first tabs protrude towards the second rib and the second tabs protrude towards the first rib. The first tabs 16*a*' fit into the recesses between the second tabs 16*a*" and the second tabs 16*a*" fit into the recesses between the first tabs 16*a*'**.

In other words, the first and second tabs overlap transversally.

Between the rim of the first rib 14' and the first tabs **16*a*' and the rim of the second rib and the second tabs 16*a*" a through slot 22** is preferably present for drainage.

According to a preferred embodiment, the support structure 12 is made in one piece, for example by moulding a plastic material.

According to yet a further embodiment the composite structure 6 comprises an over layer 24 in textile material, laid over the support structure 12; the support structure 12 therefore finds itself in an intermediate position between the under layer 10 and the over layer 24.

Preferably, the over layer has structural and functional characteristics similar to those described for the under layer 10.

Preferably, the composite structure 6 formed of an under layer 10, intermediate support structure 12 and over layer 24 is a modular panel.

The floor according to the invention therefore envisages, in one embodiment, in succession from the bottom outwards, the substrate 2, for example in clay, the waterproof layer 4, the composite structure 6 formed of an under layer 10, the flexible support structure 12 and the over layer 24, and the covering 8, for example in synthetic grass.

When the floor is walked over, often with force since the user is running or falling, the compression effect is at least partially transmitted to the support structure 12 which yields, in part thanks to the special tab structure which slides over the under layer without mutual interference.

Moreover, the tabs, when compressed, slide over the crests of the under layer without there being any sticking in said crests, since the tabs extend transversally and the crests in the deformation direction, thereby forming tracks which the tabs slide on.

Innovatively, the floor according to the invention comfortably dampens the effect exerted on it during running or falling.

Advantageously, furthermore, the floor allows drainage of water, preventing the formation of puddles.

According to a further advantageous aspect, the floor is simple and cheap to make, since the panels can be placed next to each other in a modular manner and connected.

According to a further advantageous aspect, the support structure comfortably dampens impact and in particular opposes a gradually stronger resistance to deformation.

It is clear that a person skilled in the art may make modifications to the floor and composite structure described above.

For example, in one embodiment variation, the tabs are arched to as to be concave towards the substrate or under layer.

Figure 5:
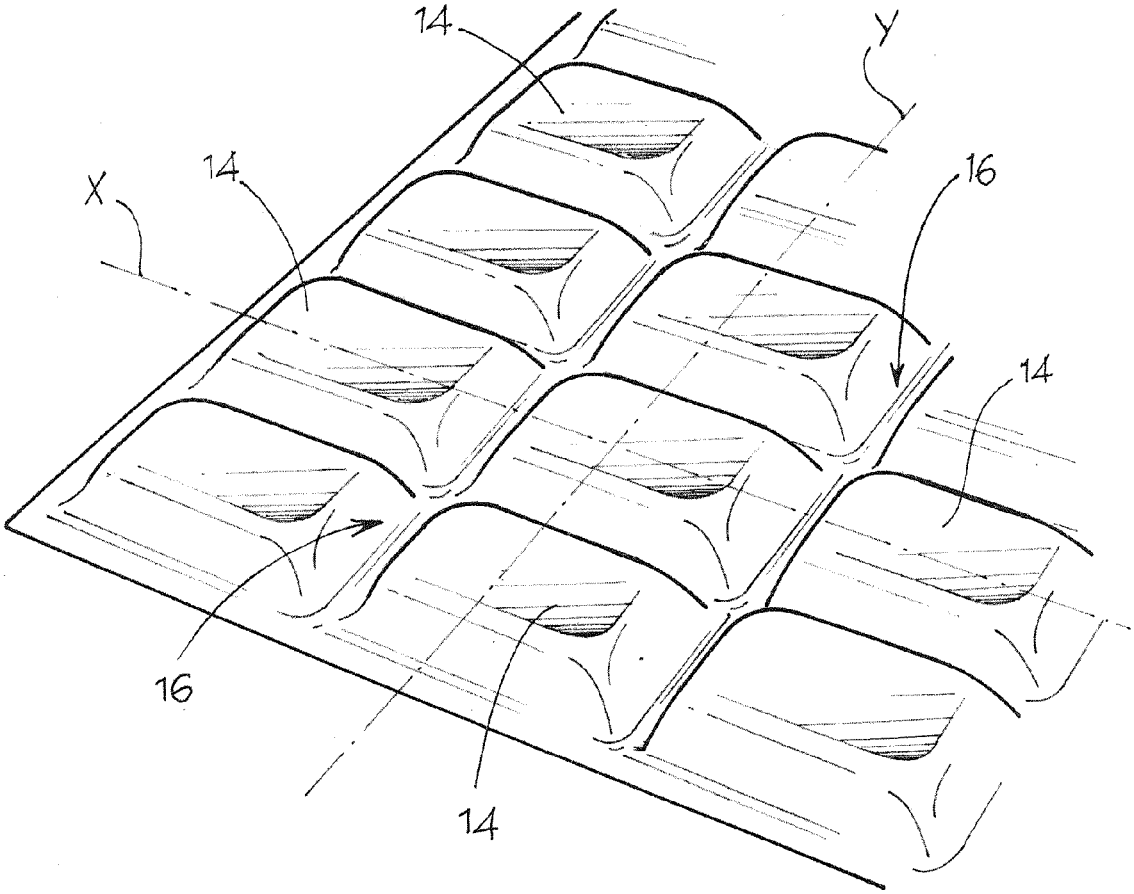
FIG. 5 shows a support structure of the floor in FIG. 1 according to a further embodiment variation.
Figure 2:
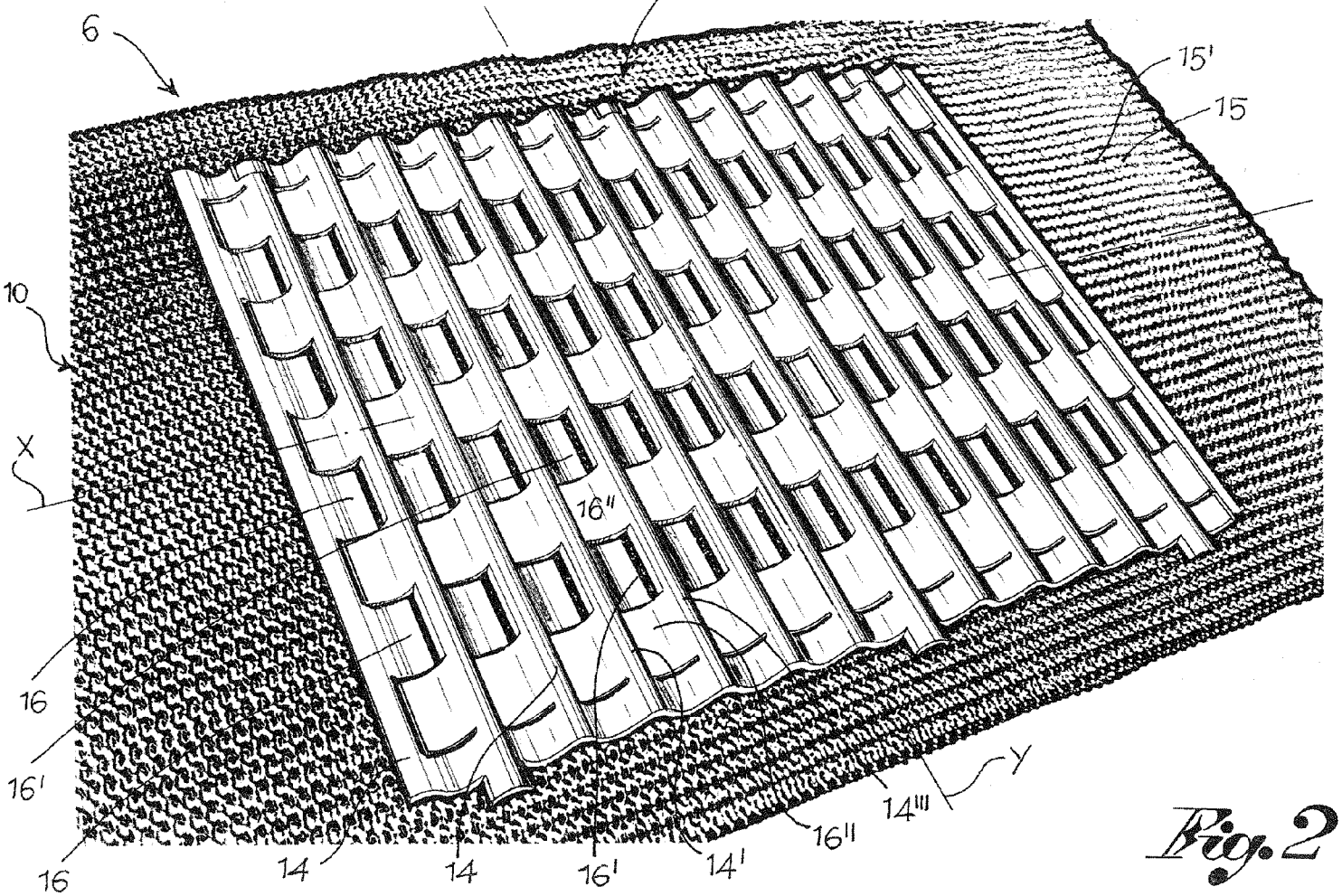
FIG. 2 shows a perspective view of a composite structure of the floor in FIG. 1.
Figure 4:
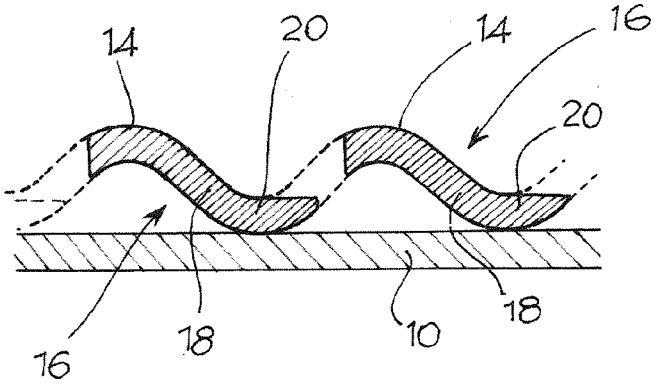
FIG. 4 shows a cross-section schematic view of the composite structure in FIG. 2.
Figure 3:
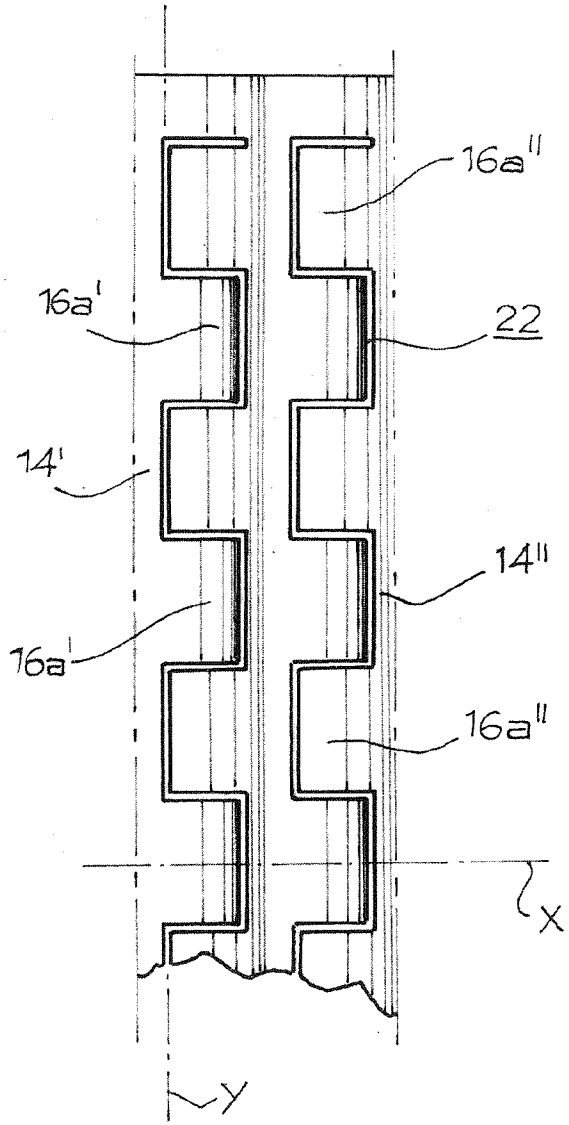
FIG. 3 shows a schematic view from above of a support structure of the floor in FIG. 1.

In a further embodiment, the support structure comprises a number of elements dome-shaped, such as semi-spherical caps, in the shape of a truncated cone, in the form of a truncated pyramid, and the like, projecting from the substrate or under layer to form the elastically yielding elements (FIG. 5).

In yet a further embodiment, the tabs comprise rectilinear sections connected to each other.

Figure 6:
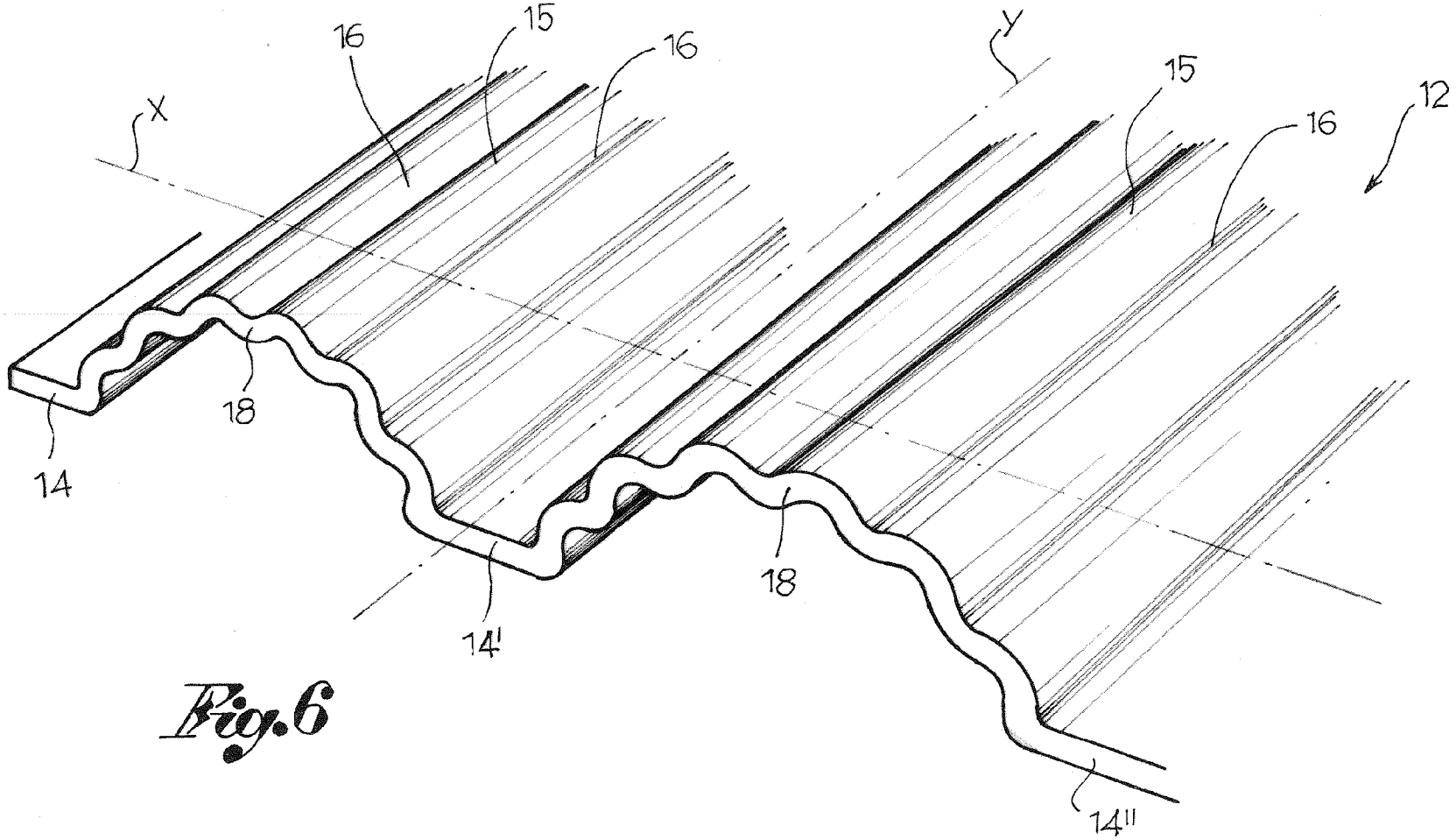
FIG. 6 shows a perspective view of a composite structure of the floor in FIG. 1 according to a further embodiment.

In a further embodiment, the support structure 12 comprises ribs 14 laid on the under layer 10, from which the overhanging portions 18 project, for example arched in a concave manner towards the under layer 10, as far as the subsequent rib (FIG. 6).

Preferably, the overhanging portions 18 have bosses 114 which extend transversally, forming a sequence of crests 15 and valleys 15'.

These variations too fall within the sphere of protection as defined by the following claims.

The invention claimed is:

1. A flooring comprising:

a substrate, for example made in clay;

a covering, for example in synthetic grass, laid over the substrate; and an intermediate elastic support structure positioned between the substrate and the covering;

wherein the support structure extends over the substrate in a deformation direction in an undulated manner, creating overhanging portions spaced from the substrate to obtain the desired yield, wherein the structure comprises, a) support portions to support the structure, connected to the overhanging portions, wherein the overhanging portion and the relative support portion form a tab; and b) main ribs, from which the overhanging portions protrude.

2. The flooring according to claim 1, wherein the main ribs, in a non-deformed configuration of the structure, are distanced from the substrate.

3. The flooring according to claim 2, wherein the main ribs are rectilinear and extend in a transversal direction orthogonal to the deformation direction.

4. The flooring according to claim 1, wherein from a first main rib a number of first tabs protrude;

from a second main rib, subsequent to the first rib along the deformation direction, a number of second tabs protrude; and wherein the first and second tabs are alongside each other in a transversal direction and alternate with each other.

5. The flooring according to claim 4, wherein the first and second tabs overlap in a transversal direction.

6. The flooring according to claim 4, wherein the first tabs are separated from the second tabs.

7. The flooring according to claim 4, wherein between subsequent ribs a depression forms extending in a transversal direction and fitted with through slots for drainage.

8. The flooring according to claim 1, wherein the tabs are arched.

9. The flooring according to claim 1, wherein the tabs are of decreasing thickness from the proximal extremity connected to the main rib towards the free distal extremity.

10. The flooring according to claim 1, wherein the support structure is made in one piece in plastic material.

11. The flooring according to claim 1, comprising an under layer in textile material on which the support structure rests, the under layer resting on the substrate.

12. The flooring according to claim 11, wherein the under layer has crests and valleys which extend in a rectilinear manner in the direction of deformation.

13. The flooring according to claim 1, wherein the crests of textile material support the support portions of the support structure.

14. The flooring according to claim 1, comprising an over layer in textile material laid over the support structure, the covering resting on the over layer.

15. A composite structure for a flooring, comprising:

an elastically yielding elastic support structure; and an under layer in textile material to which the support structure is attached, wherein the support structure extends over the under layer in a deformation direction in an undulated manner, creating overhanging portions to give the desired yield, and wherein the support structure comprises:

a) support portions to support the structure, connected to the overhanging portions, wherein the overhanging portions and the relative support portions form a tab; and b) main ribs, from which the overhanging portions protrude.

16. The composite structure according to claim 15, comprising an over layer in textile material, attached to the support structure, the support structure being positioned between the under layer and over layer.

17. The composite structure according to claim 15, made in the form of a modular panel.

18. The composite structure according to claim 15, wherein the under layer comprises crests and valleys which extend in a rectilinear manner along the deformation direction.

* * * * *